US005303968A

United States Patent [19]

Trine

[11] Patent Number: 5,303,968

[45] Date of Patent: Apr. 19, 1994

[54] LOCKING MECHANISM FOR BARREL LIFTING APPARATUS

[75] Inventor: Ralph D. Trine, Fremont, Ind.

[73] Assignee: Vestil Manufacturing Corporation, Angola, Ind.

[21] Appl. No.: 23,349

[22] Filed: Feb. 26, 1993

[51] Int. Cl.[5] ..... B66C 1/66

[52] U.S. Cl. ..... 294/106; 294/90

[58] Field of Search ..... 294/16, 28, 31.1, 67.31, 294/90-92, 104, 106, 108, 109, 110.1, 111, 112, 117, 118

[56] References Cited

U.S. PATENT DOCUMENTS

| | | | |
|---|---|---|---|
| 1,184,367 | 5/1916 | Moore | 294/106 X |
| 1,212,822 | 1/1917 | Schlepp | 294/28 |
| 1,580,083 | 4/1926 | Boadle | 294/104 |
| 2,526,085 | 10/1950 | Rotollo | 294/118 |
| 2,576,193 | 11/1951 | Reynolds | 294/90 X |
| 2,758,869 | 8/1956 | Shaw | 294/106 X |
| 2,819,924 | 1/1958 | Hayes | 294/104 X |
| 2,831,720 | 4/1958 | Renfroe | 294/90 X |
| 3,011,821 | 12/1961 | Doty | 294/104 |
| 3,068,036 | 12/1962 | Doty | 294/104 |
| 3,330,591 | 7/1967 | Pavelka | 294/90 |
| 3,352,591 | 11/1967 | Casey | 294/90 X |
| 3,897,096 | 7/1975 | Garrison et al. | 294/90 X |
| 3,915,488 | 10/1975 | Anderson | 294/90 |
| 4,009,898 | 3/1977 | Hampton | 294/90 X |
| 4,097,084 | 6/1978 | Russell | 294/104 |
| 4,359,241 | 11/1982 | Kistner | 294/90 X |
| 4,619,475 | 10/1986 | Sylvest, II | 294/90 |
| 4,637,645 | 1/1987 | Eriksson | 294/104 |
| 4,832,391 | 5/1989 | Moell | 294/90 X |
| 5,171,053 | 12/1992 | Rouleau | 294/106 |

OTHER PUBLICATIONS

Liftomatic Material Handling, Inc. product information sheet, no date.

*Primary Examiner*—Johnny D. Cherry
*Attorney, Agent, or Firm*—George Pappas

[57] ABSTRACT

An apparatus for lifting a cylindrical barrel includes a first arm having a lifting frame at one end and a chime gripping arch at the other end. A second arm is pivotally connected at one end thereof to the lifting frame and includes a second chime gripping arch at its other end. During operation, the chime gripping arches are placed on the barrel outer surface just under the barrel chime and by lifting the lifting frame, the two chime gripping arches are forced toward one another and against the barrel surface just under the chime. A locking arm is pivotally connected to the first arm and is selectively pivotable for engaging the second arm and creating a locking triangle. The locking arm effectively, selectively locks the first and second arms with respect to each other preventing radial movement thereof and preventing movement of the chime gripping arches away from the barrel.

12 Claims, 2 Drawing Sheets

LOCKING MECHANISM FOR BARREL LIFTING APPARATUS

TECHNICAL FIELD

The present invention relates to the technical field of apparatuses used in lifting and moving large drums or barrels. More specifically, the present invention is directed to an apparatus having two pivotally connected arms adapted for gripping a barrel just under the chime and thereby lifting the barrel and, further, wherein the apparatus is improved by providing a mechanism for selectively locking the two arms and preventing radial movement thereof when a drum is being carried by the apparatus.

BACKGROUND OF THE INVENTION

Barrels or "drums", as they are now commonly referred to, are presently being used for storing and transporting both liquids and numerous different component parts, articles and things. A common size is 55 gallons. Such barrels are normally made of steel or fiberglass and are cylindrically shaped and closed at each longitudinal end thereof with a disk-shaped cap or cover. These drums normally also have a radial lip at each longitudinal end thereof extending radially beyond the barrel outer surface. This lip is commonly referred to as a "chime".

Although these barrels are easily manufactured and inexpensive, due to their shape, they are generally difficult to move around and transport, especially when they are full with a heavy liquid or other material. So as to accommodate the transporting of such barrels, various devices have been developed whereby the barrel can be grasped at one longitudinal end thereof and lifted vertically upwardly and thus moved to another location. During this transporting, the longitudinal axis of the barrel remains substantially vertical so that, if the barrel is open at the top, the liquid or material therein is not spilled.

Examples of barrel lifting devices are shown in U.S. Pat. No. 2,576,193 and U.S. Pat. No. 3,915,488. These devices include three arms extending radially outwardly from a common center lifting pivotal point. Each of the arms include a semi-circular or arch portion at their radial ends thereof adapted for fitting just under the barrel chime and against the barrel outer cylindrical surface. When the device is placed on the drum and lifted vertically upwardly at the center lifting pivotal point, the arms collapse radially inwardly forcing the semi-circular portions against the barrel just under the chime. Thus, the barrel can be lifted from the lifting pivotal point and transported as needed to another location.

Another device similar to the three arm type devices has also been developed and marketed. This device includes a first arm having a semi-circular portion or shoe at one end and a lifting frame at the other end. The lifting frame is situated at an obtuse angle with respect to the first arm and is rigidly connected thereto. A second arm is pivotally connected to the lifting frame at one end and includes a semi-circular portion or shoe at the other end thereof. Similar to other barrel lifting devices, this two arm device is placed on one longitudinal end of the barrel with the semi-circular portions just under the chime and against the barrel outer surface. When the lifting frame is pulled upwardly, the two arms along with their semi-circular portions are forced toward one another. Thus, the semi-circular portions are forced against the outer surface of the barrel just under the chime and the barrel can be lifted and transported as needed.

Although the two arm devices function adequately, because the chime is relatively small, if the arms were to pivot slightly allowing the semi-circular portions to move away from the barrel outer surface, it is possible for the barrel to be inadvertently released by the lifting apparatus. As can be appreciated, this can be a safety hazard, especially if the barrel is filled with a heavy or dangerous liquid or material. Further, although the vertical lifting force on the lifting frame causes sufficient corresponding forces on the two arms and semi-circular portions towards the barrel outer surface, it is possible for the arms to be bumped or otherwise be jarred in a manner whereby one of the semi-circular portions could slip over the chime thus releasing the barrel.

Accordingly, a need exists for a barrel lifting apparatus which is generally easy to use in lifting barrels and which helps prevent the inadvertent potential of the semi-circular portions slipping or the arms pivoting and inadvertently releasing the barrel. A need exists for an improved barrel lifting device that helps positively lock the arms in position after the apparatus has been placed on the barrel with the semi-circular portions under the chime and which, thus, prevents the potential release of the barrel during lifting and transport.

SUMMARY OF THE INVENTION

It is the principal object of the present invention to overcome the above-discussed disadvantages associated with prior barrel lifting devices.

The present invention overcomes the disadvantages associated with prior two arm type barrel lifting devices by providing a mechanism for selectively locking the two arms with respect to each other and preventing radial movement thereof, thus, also effectively preventing the semi-circular or arch portions at the end of the arms from moving away from the barrel surface. More specifically, the locking mechanism includes a locking arm which is pivotally connected to the first arm at one end and engages the second arm at its other end. A locking triangle is, thus, selectively formed with end points at the pivotal connection between the second arm and the lifting frame, at the pivotal connection between the locking arm and the first arm, and at the point whereat the locking arm engages the second arm.

Preferably, the pivoting axis between the locking arm and first arm is parallel to the pivoting axis between the second arm and the lifting structure. Also, preferably, the locking arm includes a notch adapted to selectively receive and retain therein a portion of the second arm.

In one form thereof, the present invention is directed to an apparatus for gripping and lifting a cylindrical barrel having a chime at one longitudinal end thereof. The apparatus includes a first arm having a chime gripping arch attached at one end thereof and having a lifting portion at the other end thereof. The lifting portion is at an angle with respect to the rest of the first arm. A second arm is provided having a chime gripping arch attached at one end thereof and being pivotally connected at the other end thereof to the lifting portion. Thus, placement of the apparatus on the barrel longitudinal end with the gripping arches on the barrel and pulling the lifting portion away from the barrel causes the chime gripping arches to be forced towards one another and towards the barrel. The improvement includes a mechanism for selectively locking the first and second arms with respect to each other and preventing radial movement thereof and of the chime gripping arches in a direction away from the barrel.

BRIEF DESCRIPTION OF THE DRAWINGS

The above mentioned and other features and objects of this invention and the manner of obtaining them will become more apparent and the invention itself will be better understood by reference to the following description of embodiments of the invention taken in conjunction with the accompanying drawings wherein.

Corresponding reference characters indicate corresponding parts throughout the several views of the drawings.

Figure 1:
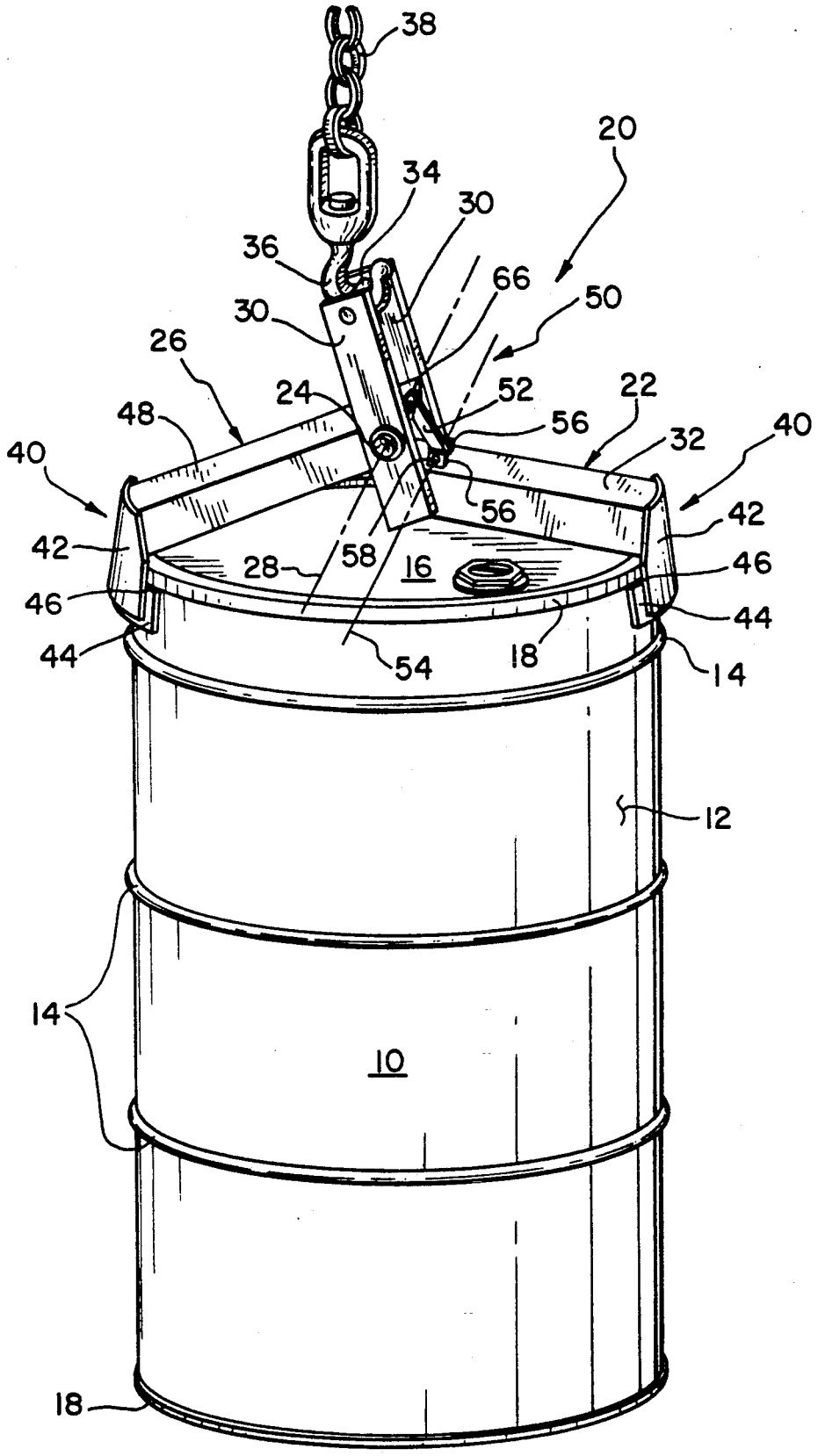
FIG. 1 is a perspective view of a barrel lifting apparatus lifting a barrel and showing the locking mechanism on the apparatus according to the present invention.

The exemplifications set out herein illustrate preferred embodiments of the invention in one form thereof and such exemplifications are not to be construed as limiting the scope of the disclosure or the scope of the invention in any manner.

DETAILED DESCRIPTION OF A SPECIFIC EMBODIMENT

Referring now to the drawings, there is shown a barrel 10 having an outer cylindrical surface 12 and circumferential supporting ribs 14. Barrel 10 is closed at its upper end with a lid 16. Barrel 10 further includes circumferential lips or chimes 18 extending radially beyond outer cylindrical surface 12. Chimes 18 are located at each longitudinal end of barrel 10.

A barrel lifting apparatus, according to the present invention, is indicated generally by the numeral 20. Apparatus 20 includes a first arm 22 pivotally connected via pivot pin 24 to second arm 26. Thus, first arm 22 and second arm 26 pivot about a first axis 28 which is substantially perpendicular to both of the first and second arms 22 and 26.

First arm 22 includes a lifting portion or frame made up of two generally flat bars 30. Flat bars 30 are attached to square or quadrangle-shaped tube 32 by welding or other suitable means. Further, bars 30 are attached to square shaped tube 32 at an obtuse angle and preferably at a angle of 110 degrees to 160 degrees from the tube 32 longitudinal axis. A lifting pin 34 is affixed between flat bars 30 leaving a gap therebetween for receiving therethrough a hook 36. Hook 36 is connected to chain 38 or other suitable devices capable of lifting apparatus 20. Lifting pin 34 is of a sufficient diameter capable of withstanding the forces applied thereto when barrel 10 is lifted.

At the other end of first arm 22, opposite of the lifting frame made up of bars 30, there is provided a chime gripping member 40. Chime gripping member 40 includes a semi-circular extension 42 connected to the end of square shaped tube 32 by welding or other suitable means. A chime gripping arch 44 is, in turn, connected to semi-circular extension 42 also by welding or other suitable means. Chime gripping arch 44 has a radius of curvature substantially similar to that of the outer cylindrical surface 12 of barrel 10. A lifting edge 46 is thus provided and adapted to fit snug just under chime 18 of barrel 10.

Second arm 26 is also made of a square or quadrangle-shaped tube 48 similar to tube 32 of first arm 22. Also similar to first arm 22 there is provided on second arm 26, opposite the end pivotally connected to the first arm 22, a chime gripping member 40 made up of a semi-circular extension 42 and chime gripping arch 44. Here, also, extension 42 is attached to square-shaped tube 48 by welding or other suitable means and chime gripping arch 44 is, in turn, connected to semi-circular extension 42 by welding or other suitable means. Thus, a lifting edge 46 is provided and adapted for being located snug under chime 18 but diametrically opposite the lifting edge 46 of first arm 22.

In operation, arms 22 and 26 are pivoted about axis 28 increasing the distance between chime gripping arches 44 and, placing arches 44 just under chime 18 as shown in FIG. 1. For lifting barrel 10, as more clearly shown in FIG. 2, a vertical force is applied on lifting pin 34 as indicated by arrow A. Vertical force A creates a clockwise moment on first arm 22 about axis 28 as viewed in FIG. 2 thereby also causing chime gripping arches 44 to be forced towards one another and towards barrel 10. Chime gripping arches 44 are, therefore, retained against the barrel outer cylindrical surface 12 and just under chime 18 as long as vertical force A is applied on lifting pin 34.

So as to prevent inadvertent radial movement of either of arms 22 or 26 and preventing chime 18 from slipping off of lifting edges 46 during the lifting and/or transporting of barrel 10, a mechanism generally indicated by the numeral 50 is provided. Mechanism 50 is provided for selectively locking first arm 22 and second arm 26 with respect to each other and preventing radial movement thereof thereby also preventing chime gripping arches 44 from moving in a direction away from barrel 10. Mechanism 50 preferably includes a locking arm 52 pivotally connected to first square-shaped tube 32 of first arm 22 and adapted to pivot about axis 54. As shown, axis 54 is generally parallel to axis 28 and is also perpendicular to both arms 22 and 26. More specifically, two fingers 56 are connected to square-shaped tube 32 by welding or other suitable means and extend upwardly therefrom. A gap is provided between fingers 56 sufficient for slidingly receiving locking arm 52. A pivot pin effectively made up of bolt 58 and nut 60 extends through aligned holes (not shown) in both fingers 56 and locking arm 52 and, thus, allows locking arm 52 to pivot thereabout and around axis 54. Nut 60 and bolt 58 are preferably "locking" and washers 62 are provided for aiding the pivotal movement of locking arm 52.

Figure 2:
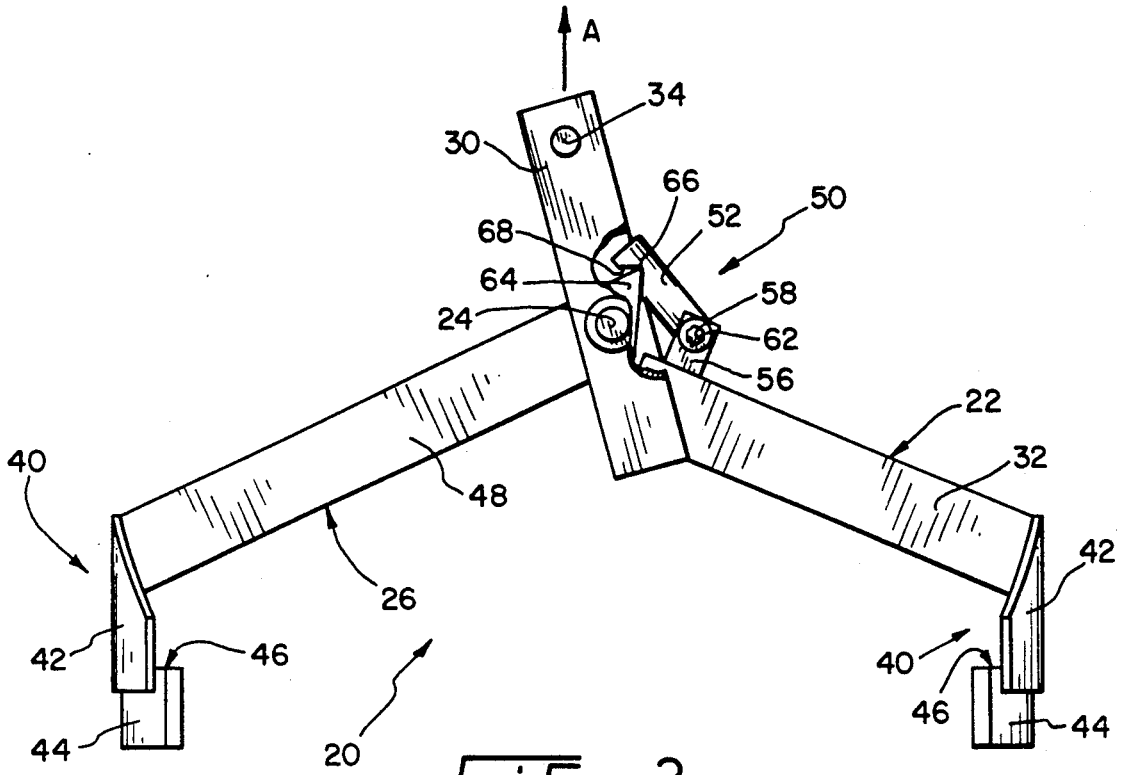
FIG. 2 is a side elevational view of the apparatus shown in FIG. 1 and showing the locking mechanism thereon according to the present invention; and, FIG. 3 is a top plan view of the apparatus and locking mechanism shown in FIG. 2.

At the other end of locking arm 52, the locking arm is adapted for selective engagement of second arm 26 so as to prevent radial movement of second arm 26 relative to first arm 22. In this regard, square-shaped tube 48 is cut at its end for forming a point 64 as viewed in FIG. 2 by, in essence, cutting tube 48 at an angle with respect to the longitudinal. An end edge 66 is, thus, formed at the tip of point 64. Edge 66 is generally parallel to both first axis 28 and second axis 54. Further, locking arm 52 is provided with a notch or cut-out 68 adapted for selectively receiving therein end edge 66 and a portion of point 64 of tube 48. As shown in FIG. 2, end edge 66 is adapted to fit snug within notch 68 of locking arm 52.

Figure 3:
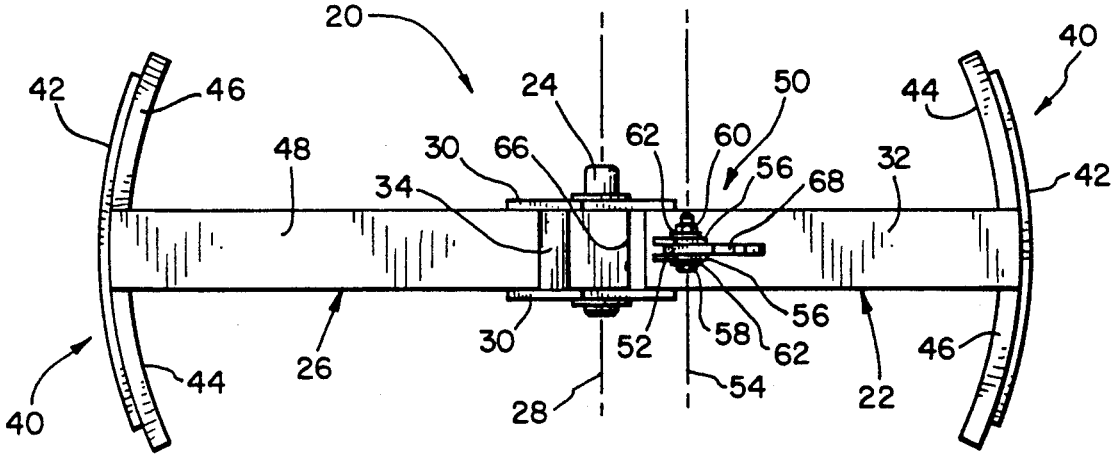

During operation, prior to and during the placing of apparatus 20 on barrel 10, locking arm 52 is retained as shown in FIG. 3 away from second arm 26 and resting on square-shaped tube 32. However, after apparatus 20 is properly placed on barrel 10 as shown in FIG. 1, locking arm 52 is pivotally rotated in position as shown in FIG. 2. In this position, a locking triangle is formed whereby both first arm 22 and second arm 26 are locked with respect to each other and are prevented from radial movement in a direction whereby chime gripping arches 44 are withdrawn from barrel 10. This locking triangle can be defined as having triangle end points at first axis 28, second axis 54, and at the engagement between end edge 66 and notch 68. After the lifting and transporting operation of barrel 10 has been completed, locking arm 52 is merely pivoted away from second arm 26 thereby, again, allowing radial movement and allowing apparatus 20 to be removed off of barrel 10.

Preferably, locking arm 52 along with fingers 56 and all other components of apparatus 20 are made of steel. However, lighter materials such as aluminum can also be utilized for decreasing the overall weight of apparatus 20.

While the invention has been described as having specific embodiments, it will be understood that it is capable of further modification. This application is therefore intended to cover any variations, uses, or adaptations of the invention following the general principles thereof and including such departures from the present disclosure as come within known or customary practice in the art to which this invention pertains and fall within the limits of the appended claims.

What is claimed is:

1. An apparatus for gripping and lifting a cylindrical barrel having a chime at one longitudinal end thereof, said apparatus including a first arm having a chime gripping arch attached at one end thereof and having a lifting portion at the other end thereof, said lifting portion being at an obtuse angle with respect to said first arm, a second arm having a chime gripping arch attached at one end thereof and pivotally connected at the other end thereof to said lifting portion at an acute angle with said first arm when said chime gripping arches are placed on said barrel longitudinal end, whereby placement of an apparatus on said barrel longitudinal end with said gripping arches on said barrel and pulling said lifting portion away from the barrel causes said chime gripping arches to be forced towards one another and towards said barrel, wherein the improvement comprises means for selectively locking said first and second arms with respect to each other and preventing radial movement thereof and of said chime gripping arches in a direction away from the barrel and, wherein said means for locking comprises a locking arm connected to said first arm at one end thereof and engagement means at the other end thereof for selectively engaging said other end of said second arm and preventing said radial movement relative to said first arm.

2. The gripping and lifting apparatus of claim 1 wherein said locking arm is pivotally connected to said first arm.

3. The gripping and lifting apparatus of claim 2 wherein said engagement means includes a notch on said locking arm adapted for selectively receiving therein a portion of said second arm.

4. The gripping and lifting apparatus of claim 3 wherein said second arm is quadrangle-shaped in cross-section, and said pivotal connection between said second arm and said lifting portion being about a first axis which is perpendicular to both said first and second arms and extending through said quadrangle-shaped second arm.

5. The gripping and lifting apparatus of claim 1 wherein a locking triangle is selectively formed having end points at said pivotal connection between said second arm and said lifting portion, at said connection between said locking arm and said first arm and at an engagement between said second arm and said engagement means.

6. The gripping and lifting apparatus of claim 5 wherein said locking arm is pivotally connected to said first arm.

7. The gripping and lifting apparatus of claim 6 wherein said engagement means includes a notch on said locking arm selectively receiving therein a portion of said second arm.

8. The gripping and lifting apparatus of claim 7 wherein both said first and second arms are quadrangle-shaped in cross-section.

9. The gripping and lifting apparatus of claim 7 wherein said second arm is quadrangle-shaped and said pivoted connection between said second arm and said lifting portion is about a first axis, said first axis extending through said quadrangle-shaped second arm, and wherein an end edge of said quadrangle-shaped second arm being generally parallel to said first axis is provided and is selectively received in said locking arm notch.

10. An apparatus for gripping and lifting a cylindrical barrel having a chime at one longitudinal end thereof, said apparatus including a first arm having a chime gripping arch attached at one end thereof and having a lifting portion at the other end thereof, said lifting portion being at an obtuse angle with respect to said first arm, a second arm having a chime gripping arch attached at one end thereof and pivotally connected at the other end thereof to said lifting portion, whereby placement of said apparatus on said barrel longitudinal end with said gripping arches on said barrel and pulling said lifting portion away from the barrel causes said chime gripping arches to be forced towards one another and towards said barrel, wherein the improvement comprises:

means for selectively locking said first and second arms with respect to each other and preventing radial movement thereof and of said chime gripping arches in a direction away from the barrel;

wherein said means for locking comprises a locking arm connected to said first arm at one end thereof and engagement means at the other end thereof for selectively engaging said second arm and preventing said radial movement relative to said first arm;

wherein said locking arm is pivotally connected to said first arm;

wherein said engagement means includes a notch on said locking arm adapted for selectively receiving therein a portion of said second arm;

wherein said second arm is quadrangle-shaped in cross-section, and said pivotal connection between said second arm and said lifting portion being about a first axis which is perpendicular to both said first and second arms and extending through said quadrangle-shaped second arm; and, wherein an end edge of said quadrangle-shaped second arm located generally parallel to said first axis is provided and is selectively received in said locking arm notch.

11. The gripping and lifting apparatus of claim 10 wherein said locking arm pivots about a second axis parallel to said first axis whereby a locking triangle is selectively formed having end points at said first axis, said second axis and at a point of contact between said end edge and locking arm notch.

12. An apparatus for gripping and lifting a cylindrical barrel having a chime at one longitudinal end thereof, said apparatus including a first arm having a chime gripping arch attached at one end thereof and having a lifting portion at the other end thereof, said lifting portion being at an obtuse angle with respect to said first arm, a second arm having a chime gripping arch attached at one end thereof and pivotally connected at the other end thereof to said lifting portion, whereby placement of said apparatus on said barrel longitudinal end with said gripping arches on said barrel and pulling said lifting portion away from the barrel causes said chime gripping arches to be forced towards one another and towards said barrel, wherein the improvement comprises:

means for selectively locking said first and second arms with respect to each other and preventing radial movement thereof and of said chime gripping arches in a direction away from the barrel;

wherein said means for locking comprises a locking arm connected to said first arm at one end thereof and engagement means at the other end thereof for selectively engaging said second arm and preventing said radial movement relative to said first arm;

wherein a locking triangle is selectively formed having end points at said pivotal connection between said second arm and said lifting portion, at said connection between said locking arm and said first arm and at an engagement between said second arm and said engagement means;

wherein said locking arm is pivotally connected to said first arm;

wherein said engagement means includes a notch on said locking arm selectively receiving therein a portion of said second arm; and, wherein said second arm is quadrangle-shaped and said pivotal connection between said second arm and said lifting portion is about a first axis, said first axis extending through said quadrangle-shaped second arm, and wherein an end edge of said quadrangle-shaped second arm being generally parallel to said first axis is provided and is selectively received in said locking arm notch.

* * * * *